US005445289A

United States Patent [19]

Owen

[11] Patent Number: 5,445,289

[45] Date of Patent: Aug. 29, 1995

[54] BULK CONTAINER WITH REMOVABLE TRAY

[75] Inventor: Donald R. S. Owen, West Sussex, Great Britain

[73] Assignee: Flomotion Limited, West Grinstead Horsham, Great Britain

[21] Appl. No.: 168,238

[22] Filed: Dec. 17, 1993

[30] Foreign Application Priority Data

Dec. 17, 1992 [GB] United Kingdom ..... 9226264

[51] Int. Cl.[6] ..... B65D 35/56

[52] U.S. Cl. ..... 222/105; 222/185.1

[58] Field of Search ..... 222/181, 185, 183, 105, 222/173, 81; 414/403

[56] References Cited

U.S. PATENT DOCUMENTS

| | | | |
|---|---|---|---|
| 2,774,515 | 12/1956 | Johansson et al. | 222/185 |
| 2,887,251 | 5/1959 | Mackridge | 222/185 X |
| 3,083,879 | 4/1963 | Coleman | 222/185 X |
| 3,318,473 | 5/1967 | Jones et al. | 222/185 X |
| 3,602,400 | 8/1971 | Cooke | 222/185 |
| 4,397,406 | 8/1983 | Croley | 222/185 X |
| 4,398,653 | 8/1983 | Daloisio | 222/185 |
| 4,660,733 | 4/1987 | Snyder et al. | 222/185 X |
| 5,086,950 | 2/1992 | Crossdale et al. | 222/185 |
| 5,096,096 | 5/1992 | Calaunan | 222/185 |
| 5,323,819 | 6/1994 | Shade | 222/181 X |

FOREIGN PATENT DOCUMENTS

| | | |
|---|---|---|
| 279332 | 10/1927 | United Kingdom . |
| 741969 | 12/1955 | United Kingdom . |
| 1155794 | 6/1969 | United Kingdom . |
| 2237559 | 8/1991 | United Kingdom . |
| 2249540 | 5/1992 | United Kingdom . |

*Primary Examiner*—Andres Kashnikow
*Assistant Examiner*—Kenneth R. DeRosa
*Attorney, Agent, or Firm*—Bacon & Thomas

[57] ABSTRACT

A tray is supported in the base of a collapsible intermediate bulk container that forms part of a container assembly, particularly for carrying viscous liquids within plastic bags. The tray includes a floor which, in use, slopes downwardly from the rear of the base towards a discharge gate carried by the base and has side portions which slope in the same direction. The tray has flanges which in use rest upon upper edges of the base. The front portion of the tray is formed with a discharge aperture, located adjacent the gate of the base, through which the nozzle of a bag can project. With this arrangement, access to the nozzle of the bag can be obtained through the gate and the sloping configuration of the tray will assure that substantially the whole content of the bag will be discharged.

11 Claims, 2 Drawing Sheets

BULK CONTAINER WITH REMOVABLE TRAY

TECHNICAL FIELD OF THE INVENTION

This invention relates to a bulk container and particularly, but not exclusively, to a collapsible intermediate bulk container of the type shown, by way of example, in our published Patent Application GB 2249540A.

DESCRIPTION OF PRIOR ART

In that published specification there is shown a collapsible container which comprises a base on which are detachably mounted two sides, a front panel with a gate, a rear panel, and an upper lid. The panels are lined with a plastic liner and adapted to receive a plastic bag with a filling nozzle and an exit nozzle. In use the plastic bag is filled with liquid or granular material and when it is emptied the exit nozzle is passed through the gate in the front door and a tool is used to rupture the bag and allow the liquid or granular material to pass out of the bag.

It will be noted that in the container described in our previous specification, the base is in the form of a pallet so that the container can be handled in the normal way by fork lift trucks.

SUMMARY OF THE INVENTION

We have found that when highly viscous materials, such as, for example, treacle, viscous resins, and some granular materials are transported in these plastic bags within the boxes, the emptying of the materials can be quite difficult and very often an unacceptably large quantity of viscous material or granular material is left in the bag and does not flow out of the exit nozzle.

An object of the present invention is to provide a means of adapting a bulk container so that even with viscous materials the majority of the material will flow freely through the exit nozzle when the bag is to be emptied.

From one aspect of the present invention, there is removable tray adapted to be supported on or within the base of a bulk container and shaped so that in use the tray has a floor portion which slopes from the back of the container towards a gate and side portions which slope from the sides of the container towards the gate, means being provided to support the tray on or in the base of a container, said means comprising flanges along the upper edges of the tray, the flanges projecting outwardly from the tray.

From another aspect of the present invention, there is a base for use with a collapsible bulk container, the base comprising support members for supporting a removable tray, the tray having flanges which rest upon front, rear and side members of the base and being provided with a front portion with an aperture in it for a discharge nozzle to pass through, the base being provided with a gate for access to the aperture and to the discharge nozzle, the removable tray having a floor portion which slopes from the back of the container towards the gate and side portions which slope from the sides of the container towards the gate.

Preferably the base is adapted to receive removable sides of the bulk container so that it may be used in place of an existing pallet type base of a bulk container.

Preferably the supporting portions of the base include struts running diagonally from one corner to another of each side of the base and horizontal bars joining the struts so that the horizontal bars act as a support beneath the floor of the tray.

Preferably the angle the floor of the tray forms with the horizontal is greater than 10 degrees and preferably 13 degrees or more, so that the slope of the floor of the tray substantially aids flow of material from the bag down the tray and out of the exit nozzle of the bag.

Preferably the angled side portions of the tray form with the horizontal an angle of at least 15 degrees and preferably 23 degrees or more.

Preferably the tray is of metal at least 2 millimeters thick and it is preferably made of galvanized, coated or stainless steel. Alternatively the tray may be made of vacuum formed plastic, preferably polypropylene.

The front panel of the tray is preferably integrally formed with the tray and has the aperture through which the nozzle can project formed in it, the aperture being positioned as near to the floor of the tray as is feasible so that the maximum amount of material can flow out of the bag. The tray is preferably provided with flanges along each of its upper edges, the flanges being arranged so that they rest snugly on struts of the base.

The fact that the tray can be removed facilitates cleaning of the tray and also enables the tray to be used with different bases.

The tray itself may be used in an existing collapsible bulk container by modifying the interior of the container, or it may be used as described above with a specially made base. The bottom of the base in this special adaptation is still provided with a pallet-like form so that it can be moved by conventional fork lift trucks. By using the special tray of this invention, it has been found possible to use the plastic bag and collapsible container with viscous liquids such as resins, treacle, etc. and to empty substantially the whole content of the bag.

While it is conventional to use 2 inch (5.08 cm) diameter nozzles when ordinary liquids are being transported, we prefer with viscous liquids to use a 3 inch (7.62 cm) nozzle.

DESCRIPTION OF PREFERRED EMBODIMENTS

Figure 1:
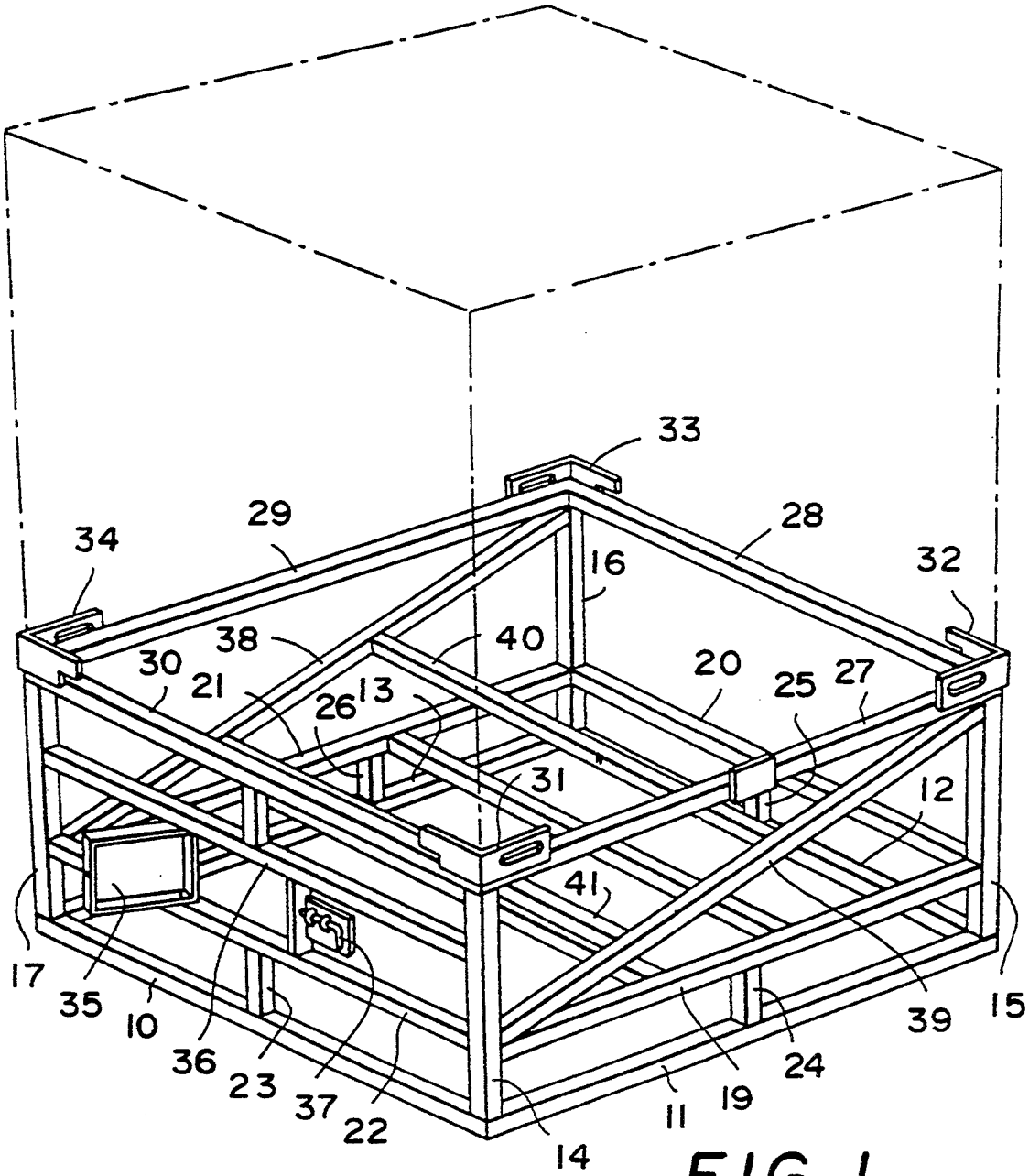
FIG. 1 shows a special base embodying the present invention.

The base shown in FIG. 1 is adapted to be used with any collapsible intermediate bulk container but is particularly for use with the bulk container shown in our patent specification 2249540. The gate shown in that patent specification as being incorporated in the front panel will no longer be used when using the base shown in FIG. 1 which incorporates its own gate.

In FIG. 1 the base comprises a pallet constructed from square metal tubes 10, 11, 12 and 13 attached to upstanding corner tubes 14, 15, 16 and 17. The pallet-type bases is completed by parallel tubes 19, 20, 21 and 22 and there are intermediate supporting tubes 23, 24, 25 and 26. The upper edges of the base are formed from square tubes 27, 28, 29 and 30 and at each corner there are upstanding corner pieces 31, 32, 33 and 34 adapted to receive the sides, front and back of the container in the manner illustrated in patent specification 2249540A, the relevant sides, front and back being shown in dotted line in FIG. 1.

The front of the base is formed with a gate 35 hinged between tube 22 and an intermediate tube 36 which is attached at its ends to the upright tubes 14 and 17 respectively. The gate 35 is provided with a latch 37. To support the tray within this base, there are provided diagonal support tubes 38 and 39 running from a front bottom corner to a rear top corner of each side of the base and horizontal tubes 40 and 41 act as cross members between the two diagonal tubes 38 and 39 so as to provide a support for the floor of a tray which is to be described.

Figure 2:
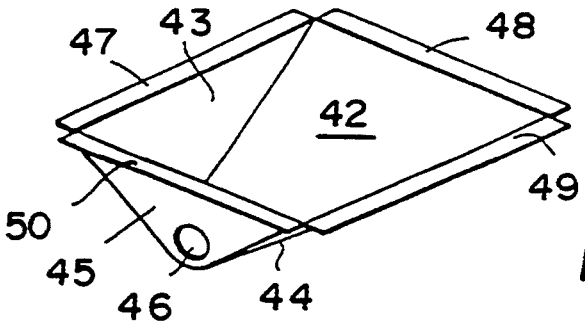
FIG. 2 shows a removable tray for use with the base of FIG. 1.

The tray is shown in FIG. 2. It comprises a floor 42 which, in use, slopes downwardly from the rear of the base towards the gate and sides 43 and 44 each of which slopes inwardly and downwardly from the sides and rear, again towards the gate when the tray is in use. The front of the tray 45 is provided with an aperture 46 which in use enables the exit nozzle of the bag to be passed through that aperture and through the gate 35 during emptying of the bag.

The upper edges of the tray 42 are each provided with flanges 47, 48, 49 and 50. In use these flanges rest respectively on the tubes 27, 28, 29 and 30 forming the upper edges of the base.

Thus the tray in use is supported by the flanges resting on the upper edges of the base and by the struts 40 and 41 which support the floor horizontally at spaced intervals. This support is necessary to prevent the tray from bending under the weight of a large plastic bag full of fairly dense and highly viscous material.

Figure 3:
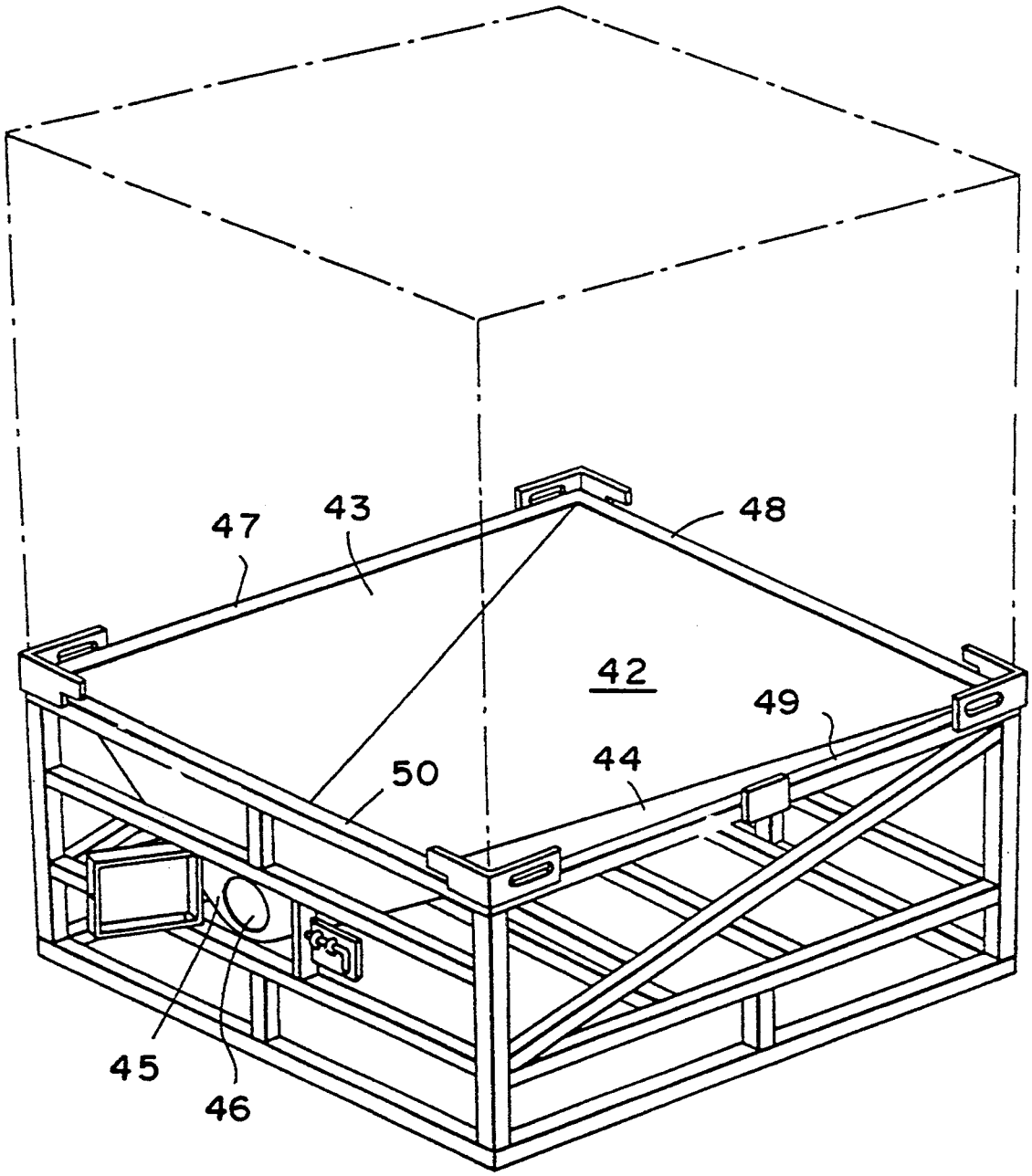
FIG. 3 shows the tray incorporated in the base.
Figure 4:
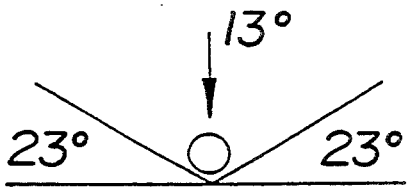
FIG. 4 diagrammatically illustrates the angles of the floor and sides of the tray.

The tray can be seen in position in FIG. 3 and for convenience the tray portions have been numbered as in FIG. 2, but numbering has not been attached to the remaining parts of the base which are exactly the same as in FIG. 1.

In using this tray and base, the tray is initially placed inside the base and then the sides and front of the container are put into position as illustrated in our published Patent Application 2249540A.

The plastic bag is then put into the container, resting on the tray, and is filled. The lid is attached to the bulk container. The container is then sent to its destination and on arrival the front gate 35 in the base is opened and the discharge nozzle of the bag, which projects through the aperture 46, has a tool attached to it which enables the plastic bag to have a hole cut in it to enable the contents to escape and suitable pipes or other devices are attached to the nozzle to convey the contents of the bag to a storage chamber or wherever it is needed.

By using a tray which slopes as illustrated, we have found that substantially the whole content of the bag can be emptied, even when it is used with viscous liquids and, in the case of non-viscous liquids, the rate of emptying is increased.

I claim:

1. A container assembly comprising:

a collapsible bulk container having side, front and rear panels;

a base having front, rear and side members, and means to detachably receive the side, front and rear panels of the container;

a gate carried by said base; and a tray, the tray having means for removably supporting the tray within the base, said means for removably supporting including flanges provided along an upper edge of the tray, the flanges projecting outwardly of the tray and, in use, rest on the front, rear and side members of the base, the tray further having a floor portion which slopes downwardly from the rear panel of the container towards said gate and sidle portions which slope down from the side panels of the container towards the gate.

2. A container assembly according to claim 1, wherein the floor portion of the tray forms with the horizontal an angle greater than 10 degrees so that the slope of the tray aids flow of material from a bag placed on said tray.

3. A container assembly according to claim 2, wherein the floor portion of the tray forms with the horizontal an angle greater than 13 degrees.

4. A container assembly according to claim 1, wherein the side portions of the tray form with the horizontal an angle of at least 15 degrees.

5. A container assembly according to claim 4, wherein the side portions of the tray form with the horizontal an angle of at least 23 degrees.

6. A container assembly according to claim 1, wherein the tray is formed of metal which is at least 2 millimeters thick.

7. A container assembly according to claim 6, wherein the tray is made of galvanized, coated or stainless steel.

8. A container assembly according to claim 1, wherein the tray is made of vacuum formed plastic.

9. A container assembly according to claim 8, wherein the vacuum formed plastic is polypropylene.

10. A container assembly according to claim 1, wherein the tray is integrally formed with a front panel in which there is an aperture through which a nozzle can project to discharge through said gate.

11. A container according to claim 1, wherein the base includes a bottom that constitutes a pallet.

* * * * *